United States Patent [19]

Valdez

[11] Patent Number: 4,685,477

[45] Date of Patent: Aug. 11, 1987

[54] CIGAR OR CIGARETTE HOLDER

[76] Inventor: Loredana G. Valdez, 15 Hillcrest Rd., Caldwell, N.J. 07006

[21] Appl. No.: 810,359

[22] Filed: Dec. 18, 1985

[51] Int. Cl.[4] ..... A24F 13/02; A24F 13/22

[52] U.S. Cl. ..... 131/175; 131/198.1; 131/202; 131/187; 131/349

[58] Field of Search ..... 131/175, 187, 202–204, 131/349, 198 R, 205, 189

[56] References Cited

U.S. PATENT DOCUMENTS

| | | | |
|---|---|---|---|
| 2,499,733 | 3/1950 | Di Rubbio | 131/175 |
| 2,761,456 | 9/1956 | Pirrone | 131/175 |
| 3,267,941 | 8/1966 | Doppelt | 131/204 |
| 3,612,068 | 10/1971 | Higbee | 131/175 |
| 4,289,149 | 9/1981 | Kiriakou | 131/175 |
| 4,386,616 | 6/1983 | Rosen | 131/175 |

*Primary Examiner*—Richard J. Apley
*Assistant Examiner*—H. Macey
*Attorney, Agent, or Firm*—John N. Bain; Raymond J. Lillie

[57] ABSTRACT

A cigar or cigarette holder capable of receiving a cigar or cigarette and for filtering smoke generated from the cigar or cigarette. The holder has three chambers. The first chamber defined by the space between a perforated tubular member, concentrically situated around a perforated inner tubular member, and the inner tubular member. The first chamber is substantially filled with a filter material. The second and third chambers are within the inner tubular member, substantially coaxially aligned and separated by a wall having an aperture to transfer ash from the second chamber to the third chamber.

3 Claims, 5 Drawing Figures

CIGAR OR CIGARETTE HOLDER

This invention relates generally to a device for assisting an individual in the smoking of tobacco which is in the form of a cigarette or cigar. Most recently, there has been a widespread anti-smoking campaign in the United States and abroad, based on the various adverse health aspects of smoking as well as the rights non-smoking individuals who prefer to avoid exposure to so called "random smoke" and/or "secondary smoke". In furtherance of in the wide spread anti-smoking campaign, smoking has generally been prohibited in "no smoking areas" on trains, subways and in taxicabs, buses and the like. Many restaurants, theaters and other public places have prohibited smoking or have restricted the smoking of tobacco to designated areas. Due to the frequently unpleasant nature of tobacco smoke to non-smoking persons, such non-smoking individuals may feel adverse health effects upon exposure to tobacco smoke, such as dizziness, sinus congestion, coughing, and other symptoms. These annoying and unhealthy side effects may affect the smoker as well, who may be bothered by secondary smoke lingering in the air and burning the smokers eyes or sinuses. Further, the lingering odor due to smoking may further be bothersome to non-smoking individuals.

Further describing the disadvantages of smoking tobacco products without the use of Applicant's invention, smoking individuals frequently tend to drop cigar or cigarette ashes accidently or inadvertently on the floor, carpet, etc. as the cigarette or cigar is smoked upon moving the cigarette or cigar in the smoker's hand. As such, ashes may tend to become ubiquitous throughout a smoker's home, or within the confines of the smoker's work place.

Frequently, a smoker may light a cigarette or cigar and thereafter set the lighted cigar or cigarette down without using an ash tray, causing said cigarette or cigar to char any substance with which the ember comes in contact. Similarly, in crowded areas, a lighted cigarette or cigar is hazardous to other persons in that a smoker may inadvertently or accidentally touch another individual with the ember end of a lighted cigarette or cigar, thererby injuring or burning the individual, or the individual's clothing.

These safety hazards and disadvantages as well as other disadvantages not described are largely overcome by the Applicant's invention, wherein a smoke filtering device is provided, having a tubular smoke absorbent filter which receives the ember end of a cigar or cigarette. Additionally a tubular member with a wall, the wall having a plurality of perforations therethrough may be provided. The tubular member may further have an open first end for insertion of the ember end of a cigarette or a cigar into the lumen of the tubular member, and a second end opposite the first insertion end, and further having smoke absorbent filter material contained therein.

As described and used herein, the term "secondary smoke" is used to describe any smoke which is exhaled by the smoker into the atmosphere. The term, "primary smoke" is used to describe the smoke which is drawn by the smoker through the filter end of the cigar or cigarette and which may be inhaled. The term "random smoke" is used to describe the smoke generated by the ember at the lighted ember end of a cigar or cigarette which is not drawn through the cigar or cigarette by the smoker. Random smoke is clearly the most bothersome to non-smoking individuals in that random smoke tends to dissipate unfiltered into the atmosphere, causing the typical tobacco smoke odor to permeate a room or area and irritating the eyes of those in the vicinity of the lighted cigar or cigarette. As such, Applicant's invention is useful for purifying random smoke prior to its dispersing into the atmosphere. Purification of random smoke further tends to reduce the annoyance to non-smoking individuals in that little or no smoke is detected by such non-smoking individuals. In this manner, the health risk to non-smoking individuals due to random smoke is essentially eliminated. Purification of the random smoke generated by cigars or cigarettes drastically reduces the typical tobacco odor which permeates the room or smoking area when such tobacco is smoked without the use of Applicant's invention. This in turn greatly reduces the need for ventilation within the confines of the smoking area, and further reduces the complaints which are frequently forthcoming from non-smoking persons. In this manner, Applicant's invention is ideal for use by smoking persons within the confines of airline cabins, taxis, other means of public transportation, or in similarly enclosed public areas. Appplicant's invention is useful for maintaining clean air generally in that less smoke is released into the atmosphere from burning tobacco.

Applicant's invention further encompasses the purification system described above, in conjunction with an ash chamber, which is used to catch and retain the ashes which fall from the ember end of the lighted cigarette or cigar. The ash chamber is easily cleaned simply by removing the butt end of the cigar or cigarette after it has been smoked, and tipping the tubular member to physically empty the ashes out of the first insertion end. In this manner, the user of Applicant's invention effectively retains all of the ashes resulting as the tobacco is smoked within the ash chamber, thereby keeping the smoker's home and/or work place in a clean condition free of ashes.

The tubular member utilized in Applicant's invention may be made of a non-flammable and non-heat transferable material, such that the ember end of the tobacco being smoked cannot damage the tubular member. The tubular member may thereby come in contact with objects or persons which might char or burn without causing injury or burning the individual or object. In this manner, Applicant's invention may alleviate any damage caused by the smoker's carelessness with the lighted end of the cigarette or cigar. The invention is ideal for use while smoking in bed without cause for concern as to falling asleep with a lighted cigarette or cigar, since there is practically no known incidence or risk of fire when Applicant's invention is used.

Applicant's invention will further be described with reference to the accompanying drawings, in which.

Figure 2:
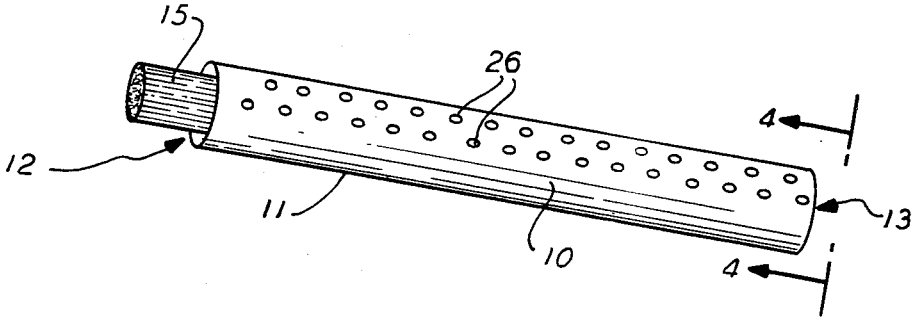
FIG. 2 is a second perspective view of an alternative embodiment of the invention.
Figure 3:
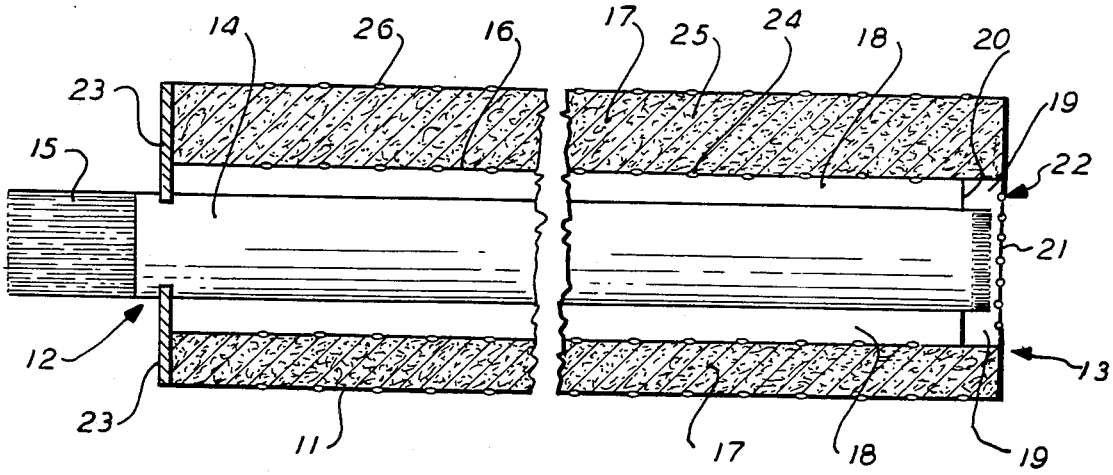
FIG. 3 is a cross-sectional side view of the invention as shown in FIG. 2.
Figure 4:
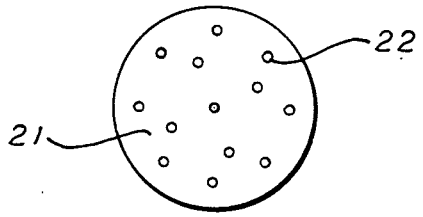
FIG. 4 is an end view as indicated generally by line 4—4 in FIG. 2.

Referring in detail to FIGS. 2 through 4 of the drawings, the cigar or cigarette holder indicated generally as 10 may be comprised of a tubular member 11, having a first insertion end 12 and a second end 13. The tubular member may be comprised of any material which is non-flammable and non-heat transfering. For example, many types of plastics are suitable in that the melting point is significantly higher than the temperature reached by the ember of the lighted cigarette or cigar. Plastics are additionally advantageous in being extremely lightweight and nontoxic when used as indicated herein. Other materials may be utilized for construction of the tubular member, such as glass, porcelain, certain metal alloys and the like. The tubular member should be shaped so as to house and fully contain the tobacco portion of the cigar or cigarette, while allowing the primary smoke filter 15 and/or mouth piece (not shown) of said cigar or cigarette to protrude from the first insertion end. The tubular member may be of any general size and shape sufficent to contain the tobacco portion of the cigar or cigarette within the lumen of the tube.

The lumen of the tubular member may additionally contain therein an inner tubular member 16 which runs essentially the length of the tubular member and is optimally colinear with the tubular member. The inner tubular member contained within the tubular member functions to define a first chamber 17 and a second chamber 18. The first chamber may be located exterior to the inner tubular member, and interior to the tubular member. As such, the first chamber is generally annularly shaped, and is concentrically situated around the second chamber. The second chamber is tubularly shaped such that upon insertion of a cigar or cigarette said cigar or cigarette enters the lumen of the second chamber. The area of the second chamber left unoccupied by the cigar or cigarette is optimally annularly shaped and surrounds the periphery of the cigarette or cigar. This area serves as the ash chamber. The second chamber may be of sufficient dimension to completely house the tobacco portion of the cigarette or cigar, except that the mouth piece or primary smoke filter is not completely inserted into the lumen of the inner tubular member. Rather, the primary smoke filter or mouth piece protrudes from the device to allow the smoker to draw primary smoke through the cigar or cigarette by placing said filter or mouthpiece between his or her lips and inhaling or drawing through said filter or mouthpiece. The annular second chamber serves to function in part as the ash chamber container into which ashes fall from the ember end of the cigarette or cigar, thereby preventing the dropping of said ashes onto the floor or the ground. Located at the second end of the tubular member within the lumen thereof may be a third chamber 19 generally defined by the inner chamber wall 20 and an end plate 21. The inner chamber wall attaches to and cooperates with the inner tubular member 16. The end plate serves to essentially plug or occlude the second end of the tubular member, except that air intake spaces 22 may be located therein. The inner chamber wall may be comprised of any suitable material such as plastic, glass, porcelain or the like; it may further be comprised of the same material as the first and/or second tubular members. The end plate may similarly be comprised of any suitable substance, similar to the inner chamber wall and/or the second tubular member, and cooperates with the tubular member. In this manner, the ember end of the cigar or cigarette inserted into the second chamber within the second tubular member will optimally be located within the confines of the third chamber. As the cigar or cigarette is smoked, and the cigar or cigarette correspondingly grows shorter, the ashes are deposited within the confines of the ash chamber. The ashes may then be transferred from the confines of the ash chamber to the confines of the third chamber or may alternatively be discarded after removing the cigarette butt or filter subsequent to finishing the cigar or cigarette.

The plurality of air intake spaces is useful for enabling the ember end of the cigar or cigarette to burn. As the smoker puffs or draws on the primary smoke filter end of the cigar or cigarette, air may be drawn into the second and third chambers through the air intake spaces to enable the ember to burn. In this manner, sufficient air is provided for burning of the tobacco to generate smoke. It is possible and within the scope of this invention to vary the size and/or number of the air intake spaces to control the rate at which the ember end of the cigar or cigarette burns. In this manner, the cigar or cigarette may be made to burn slower and therefore last longer than if smoked without the use of the Applicant's invention.

Located at the first insertion end may be a grip means 23, useful for attaching and securing the holder to the cigar or cigarette. The grip means may be of any suitable size or shape, and may ideally serve to pinch and thereby secure the cigar or cigarette within the confines of the second tubular member. For example, the grip means may be in the shape of a disc having a hole therethrough, the hole being through the center thereof, and the diameter of the hole being slightly less than the diameter of the cigar or cigarette for which the Asherette is to be used. Alternatively, a plurality of bumps or ridges may be located on the inner surface of the second tubular member which ideally press into the outer surfaces of the cigar or cigarette, securing said cigar or cigarette within the confines of the lumen of the second tubular member of the holder.

Perforating the wall of the second tubular member and placing the two chambers in communication may be a plurality of smoke passageways 24. Said smoke passageways are useful for directing random smoke away from the ember of the cigar or cigarette, and serve as the means by which random smoke is directed into the first chamber to be filtered. This prevents said random smoke from entering the atmosphere in an unpurified or unfiltered state. Located exteriorly to the second tubular member and within confines of the first chamber may be the filter material 25. The filter material may be comprised of any suitable substance which will adsorb secondary or random smoke, including the deleterious contaminants contained therein as well as the odor thereof, while being relatively impervious to the heat generated by the ember of the cigarette. The filter material may have smoke entry means (not shown) which act as the means through which smoke enters the filter material, and is essentially a portion of the filter material. Said filter material should remove from the random smoke all tar, nicotine, and other dangerous chemical compounds to thoroughly purify the random smoke generated by the burning tobacco. In this manner, the user of the holder does not pollute the environment with random smoke, nor will the smoker generate random smoke which may bother nearby individuals. Similarly the user of the holder leaves no odor of burning tobacco where the individual has smoked a cigar or cigarette. For example, said filter material may be in the shape of a tubular cartridge of overall dimensions as small as necessary, sufficient to fit within the confines of the first chamber of the asherette. The pore size of the filter material should be such that a free exchange of air may occur without unnecessarily impeding air flow, while simulataneously filtering out the tar, nicotine and other deleterious chemical compounds contained in random smoke previously described.

To enable air to flow through the air intake spaces of the third chamber, the second chamber, and through the filtering material, the tubular member may contain a plurality of air outlet means 26. The air outlet means serve as the exhaust pores through which air filtered of random smoke escapes or is released. The exhaust pores may be of any size and number sufficient to allow adequate air flow and output or release of air filtered of random smoke.

Figure 5:
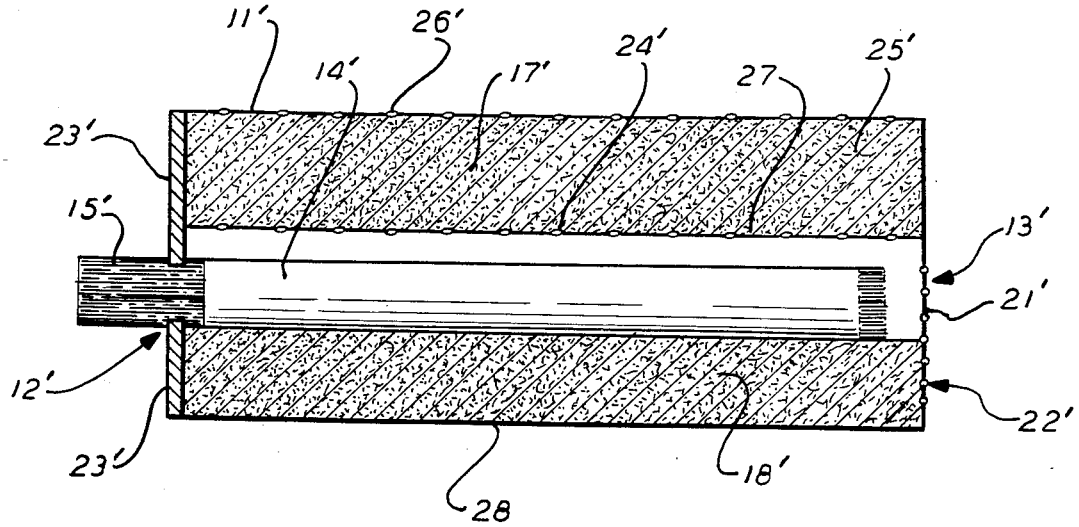
FIG. 5 is a cross-sectional view of a second alternative embodiment of the invention.

An alternative embodiment of the Applicant's invention encompasses the use of a lumen dividing plate 27 as shown in FIG. 5, which serves to divide the tubular member 11' into a first chamber 17' and second chamber 18'. Lumen dividing plate 27 may contain smoke passageways 24'. Additionally, any similar configuration of dividing paltes could be used, whereby numerous chambers may be created within the lumen of the tubular member. As described with respect to FIGS. 2 through 4, the tubular member 11' may be comprised of a first insertion end 12' and a second end 13'. The first chamber 17' may contain the smoke absorbent filter material 25'. Said smoke absorbent filter material may be archuately shaped in cross section, and may occupy essentially the entire first chamber. The second chamber 18' may contain the tobacco portion of a cigar or cigarette 14' and a portion of the primary filter 15' or mouthpiece. The second end 13' may be at least partially occluded by an end plate 21', except that air intake spaces 22' may be located therein. The first insertion end 12' of the tubular member 11' may contain therein a grip means 23', which serves to secure the cigar or cigarette within the confines of the second chamber 18'. In this manner, ashes from the lighted cigar or cigarette are deposited within the second chamber as the cigar or cigarette is smoked by the user. In such a configuration, the device generally would have a bottom 28 designated as the surface upon which the Asherette rests when not in use. The tube or corresponding filter may be flat, octagonally faceted or have feet upon which the device rests.

Another alternative embodiment of the Applicant's invention (not shown in the drawings) incorporates a tubular filter cartridge within the lumen of the tubular member without the use of a second tubular member or lumen dividing plate. By eliminating the second tubular member, a cigar or cigarette may be inserted into the insertion end of the tubular member and rests within the lumen of the tubular filter cartridge. Hence the lumen of the tubular filter cartridge may function as the second chamber into which the cigar or cigarette is inserted.

Figure 1:
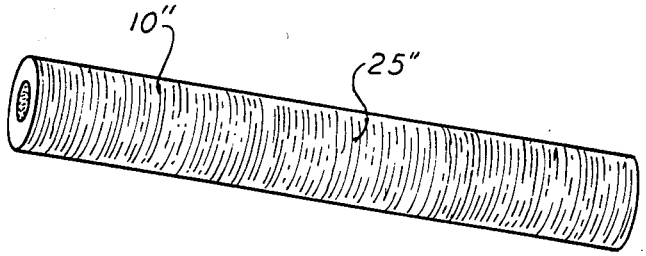
FIG. 1 is a perspective view of the invention.

Yet another alternative embodiment of the Applicant's invention encompasses the use of a tubular filter cartridge 10" having a lumen into which the lighted cigarette or cigar is inserted as show generally in FIG. 1. As previously described said cartridge may be comprised of any suitable filter material 25" which will remove the deleterious substances contained in random smoke and prevent the typical smoke odor from permeating the room. Such a tubular filter cartridge would have smoke entry means (not shown) which are essentially a portion of the filter material and are useful for allowing the smoke generated by the lighted cigar or cigarette to enter the filter material, as well as air outlet means (not shown) for the release of air filtered of smoke said air outlet means being located essentially at the outermost portion of the filter material. The filter cartridge may further be comprised of filter material which occludes the second end, thereby eliminating the need for the tubular members and end plates previously described. The filter material used in this embodiment may be comprised of the same material used in the previously described embodiments. Moreover, the filter device may be shaped so as to contain a pen or pencil tip or a different utensil at the second end of the device.

As previously described, the Asherette effectively serves as a portable ash tray and filtering device. The holder and/or the smoke filter cartridge contained in the holder may be made inexpensively so as to be disposable, but it is possible and within the scope of this invention to utilize a device which can be cleaned easily and is reusable. The simple construction of the holder makes for simple manufacturing thereof, and use of the holder effectively prevents ash spills and cigarette burns and reduces air pollution and fire hazards. Because the holder is not attached to the primary filter of the cigar of cigarette, the primary smoke drawn through the filter of the cigar or cigarette is uneffected by the holder, leaving the pleasure and taste of smoking intact for the smoker. As such, the holder is ideal for use by individuals who smoke while occupied with other activities, such as writing, reading, typing, cooking, etc., since the holder and the lighted cigar or cigarette contained therein can be placed on any surface without spilling or dropping ashes generated or burning the surface upon which it is placed thereby reducing or eliminating any fire hazard.

While numerous aspects and advantages of the Applicant's invention have been described herein, additional aspects and advantages will be obvious to those skilled in the art from the teachings herein. Consequently, the scope of Applicant's invention is not to be limited by the disclosure.

I claim:

1. A cigar or cigarette holder capable of receiving a cigar or cigarette with the lighted end contained in said holder and for filtering the smoke generated within said holder, said holder comprising three chambers, the first chamber defined by the space between a tubular member, concentrically situated around an inner tubular member, and the inner tubular member, each tubular member consisting of a wall comprising a plurality of perforations along its length, said first chamber being substantially filled with a filter means, the interior of the inner tubular member defining the second chamber for receiving the cigar or cigarette and retaining the ash therefrom, the third chamber being substantially coaxially aligned with the second chamber and being within the inner tubular member, said third chamber defined by an annular wall, a portion of the inner tubular member and an end plate having air intake means, said annular wall being at one end of the second chamber and having means to receive the ember end of the cigar or cigarette, said annular wall further cooperating with the inner tubular member, thereby providing a transfer means for transferring ash from the second chamber to the third chamber.

2. The holder of claim 1 wherein the filter means is a filter cartridge.

3. The holder of claim 1 wherein the filter means is arcuate in cross-section.

* * * * *